US005469813A

United States Patent [19]

Peden

[11] Patent Number: 5,469,813

[45] Date of Patent: Nov. 28, 1995

[54] PRISONER RESTRAINT

[76] Inventor: Kevin H. Peden, 6005 W. Excell Ave., Spokane, Wash. 99208

[21] Appl. No.: 147,490

[22] Filed: Nov. 5, 1993

[51] Int. Cl.[6] ..... E05B 75/00

[52] U.S. Cl. ..... 119/770; 70/16

[58] Field of Search ..... 119/770, 792, 119/795, 797, 798; 70/16, 18

[56] References Cited

U.S. PATENT DOCUMENTS

| | | | |
|---|---|---|---|
| 2,232,163 | 2/1941 | Brecht | 119/770 |
| 2,821,168 | 1/1958 | Forbes | 119/795 |
| 2,827,017 | 3/1958 | Ryan | 119/795 |
| 3,426,559 | 2/1969 | Schubach et al. | 119/770 X |
| 4,789,183 | 12/1988 | Wolfer | 70/16 X |

*Primary Examiner*—Robert P. Swiatek
*Attorney, Agent, or Firm*—Wells, St. John, Roberts, Greegory & Matkin

[57] ABSTRACT

A prisoner restraint having a flexible strip tether. The tether has a first loop formed at a first end. The tether is doubled back through the loop to form a noose. A detachable connection is provided at an opposing second end of the tether. The restraint is used by installing the noose about one leg. The tether is then encircled about the ankles to form circumscribing chords which hold the ankles together. The tether is then encinctured about the chords between the prisoner's legs. The second end extends up the prisoner and is secured to manacles installed on the prisoner's arms.

3 Claims, 4 Drawing Sheets

PRISONER RESTRAINT

TECHNICAL FIELD

The field of this invention is prisoner restraints for securing feet and legs behind the prisoner's back.

BACKGROUND OF THE INVENTION

Police are commonly called upon to effect an arrest. In some cases the person being arrested is unwilling to cooperate and must be secured against escape or harmful actions. In other cases a prisoner may be particularly dangerous, or have other associated risks which indicate the need to secure the prisoner even though escape or harmful actions are not being demonstrated.

Handcuffs are commonly used and provide significant restraint of a prisoner's hands thereby reducing the risk of hitting or manual operation of guns or other weapons. However, handcuffs alone do nothing to prevent a prisoner from using his feet and legs. The power of the legs make them very effective weapons. A kicking prisoner is capable of inflecting serious injury and causing significant damage. The prisoner who is merely handcuffed also is free to run and escape.

Previously it has been known that a foot restraint can be employed to disable a prisoner from using his legs and feet. Prior foot restraints have utilized a chain which is connected about the ankles and then trained up the prisoner's back and is connected to the handcuffs. Such prior foot restraints have been difficult to use in that they tend to become loosened about the ankles. They also are difficult to connect to the handcuffs of a prisoner, particularly when the prisoner is resisting arrest such as by writhing and struggling against constraint by the arresting police officers.

Thus there has long been a need in the art for a prisoner restraint system which is effective at securing feet, legs, arms and hands, and which is relatively easy to install upon a person resisting arrest.

BRIEF DESCRIPTION OF THE DRAWINGS

One or more preferred forms of the invention are described herein with reference to the accompanying drawings. The drawings are briefly described below.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

Figure 1:
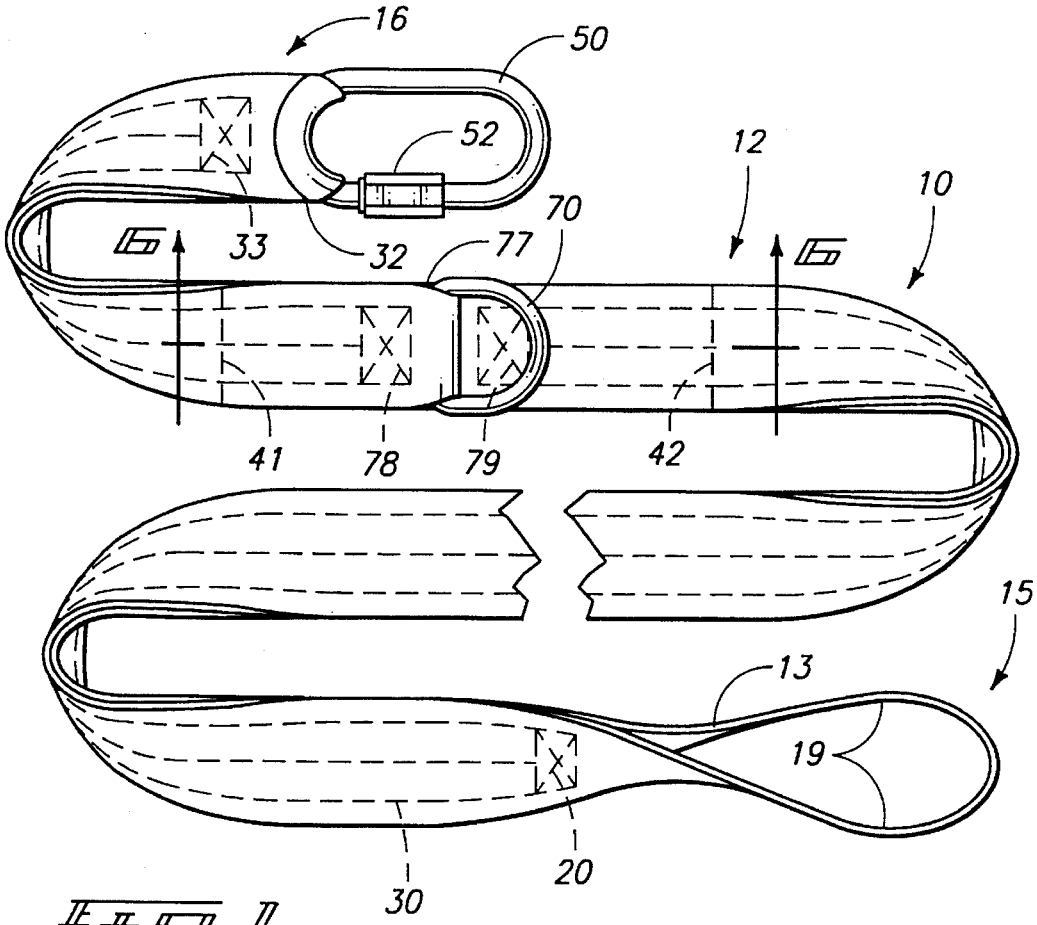
FIG. 1 is a plan view showing a preferred restraint article according to this invention. The restraint article is positioned in a sinuous condition with portions removed to simplify the illustration.

FIG. 1 shows a preferred prisoner restraint 10 made according to this invention. Restraint 10 includes a tether 12 which is preferably an elongated flexible strap. The strap shaped tether is advantageously made from a heavy strip 13 of fabric material formed in an appropriate manner, such as the preferred construction described in greater detail below. The tether is most preferably made of a relatively strong lightweight belting material, such as nylon belting material, which is capable of withstanding forces exerted by even the strongest humans. The tether is preferably about 6–9 feet (approximately 2–3 meters) in length between the first and second ends 15 and 16. Strip 13 made of nylon belting having a size of 1 inch (2.5 centimeters) wide by 1/16 inch (1.5 millimeters) thick has been found satisfactory.

Tether 12 has a first end 15 and an opposing second end 16. First end 15 is provided with a first tether loop 19. First tether loop 19 is preferably constructed by looping the fabric strip 13 and sewing two layers of the strip together at first loop stitches 20. Loop 19 is made of sufficient circumferential size to allow a portion of the tether, inward from stitches 20, to be doubled back through loop 19 to form a noose 23 (see FIG. 3). Noose 23 has a noose aperture 24 which automatically constricts about a prisoner's leg when the leg is positioned within aperture 24 and the tether is pulled.

Tether 12 is most preferably formed of multiple layers of the fabric strip 13. Through most of the tether's length there are two layers of the fabric strip. The layers are preferably joined by a suitable construction, such as the preferred triple rows of longitudinal strap stitching 30. Longitudinal stitchings 30 extend substantially from the first loop stitches 20 along the tether up to a second end loop 32 formed at the second end 16 of the tether. A break is provided for an aperture 77 which mounts ring 70. Reinforcing stitches 78 and 79 define the aperture.

The second end loop 32 is defined by a set of second loop stitches 33 sewn near the second end. The second end loop 32 has a detachable connector 50 extending therethrough. The second end loop is preferably made of a relatively small circumferential size so that the detachable connector 50 does not inadvertently become dislodged from the tether when the connector is in an open condition.

Figure 7:
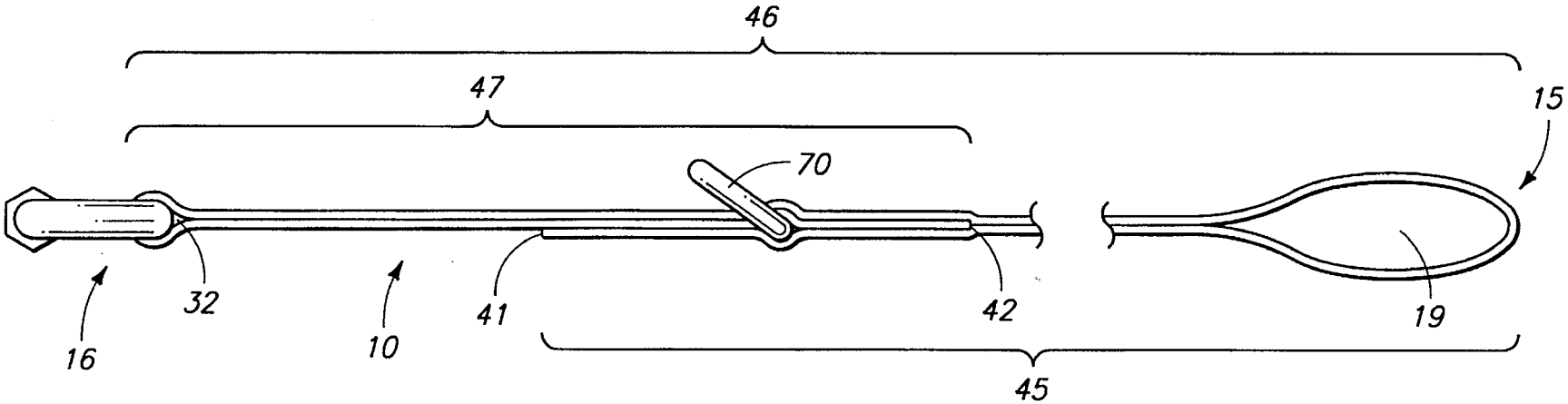
FIG. 7 is a schematic view showing the preferred arrangement for constructing the restrain of FIG. 1.

Tether 12 is constructed and has portions which are advantageously formed of a triple layer of the fabric strip 13. The triple section is formed between the first strip terminus 41 and the second strip terminus 42. The fabric strip 13 extends between the first and second strip termini 41 and 42 in a sinuous configuration to form the tether as schematically illustrated by FIG. 7. The fabric strip 13 is arranged with a first strip run or first strip portion 45 which extends from the first terminus 41 to the apex of loop 19 at first end 15. The second run or second strip portion 46 extends from loop 19 to the second loop 32 at the opposite or second end of the tether. The strip is also arranged to form a third run or third strip portion 47 which extends from the second loop 32 to the second terminus 42. The second terminus 42 of strip 13 is preferably positioned between the first and second runs 45 and 46 when assembled. The schematic relationship shown in FIG. 7 indicates the relative positioning of the fabric or other strip layers to make the restraint 10 as shown, using the preferred stitching attachment described above. It is alternatively possible to use other means of attaching the strip layers, or to stitch the layers in alternative configurations to provide the features and functions described herein.

Figure 3:
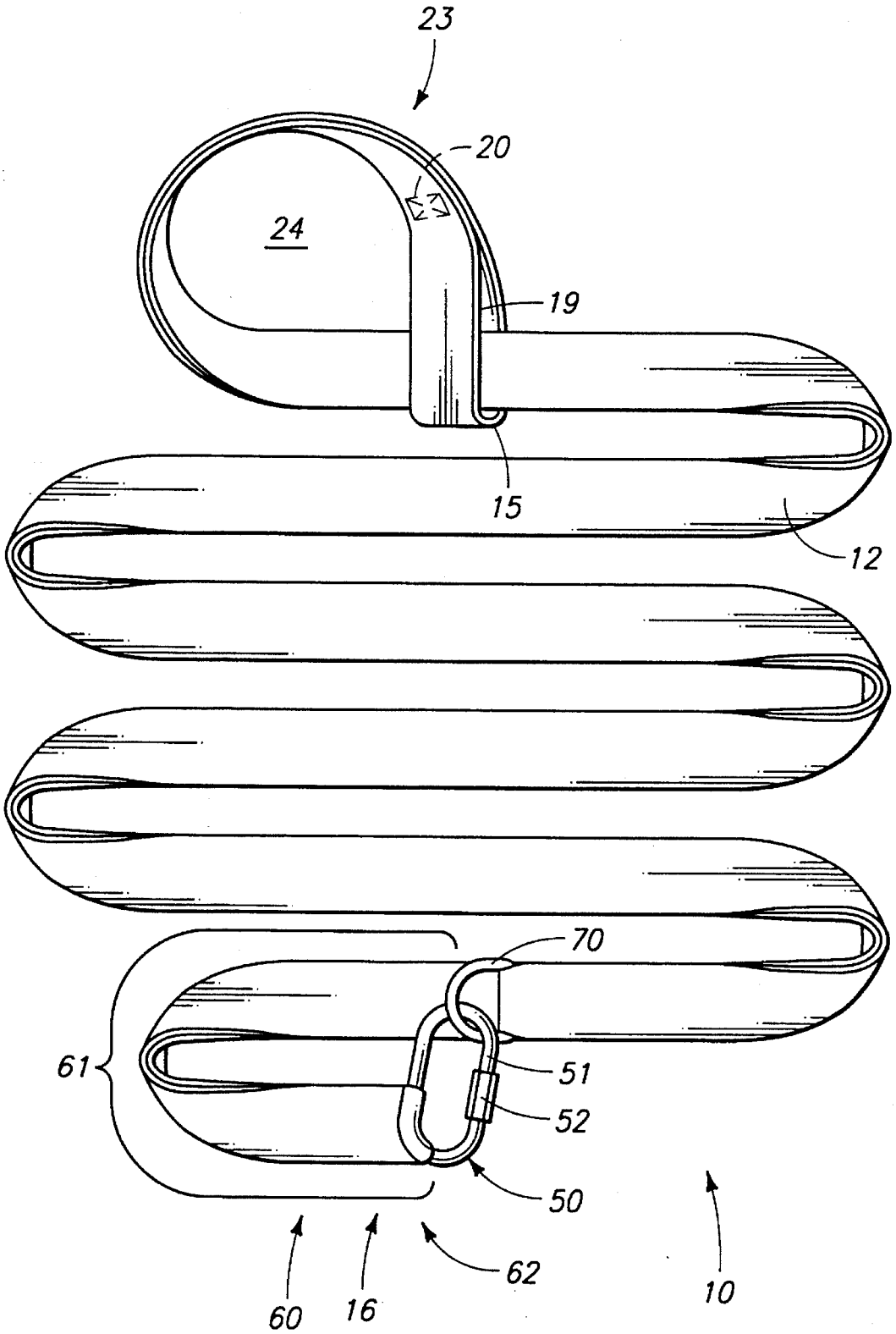
FIG. 3 is a plan view showing the article of FIG. 1 with portions connected together in a fashion as the article is used.

Restraint 10 also includes a detachable second end or detachable connection 60 shown most illustratively in FIG. 3. The detachable second end connection 60 includes the detachable connector 50 which extends through the second loop 32. Detachable connector 50 is preferably provided in the form of an annular piece which can be manually opened and closed. As shown, connector 50 is in the form of an annular rigid link, made from suitable material, such as corrosion resistant plated steel. The annular link includes a C-shaped band piece 51 which forms most of the annular link. The band is formed into a nearly circuitous piece having a threaded head which mounts an internally threaded fastener piece 52 secured thereon. Turning the threaded fastener 52 upon the head from an open position brings the internal threads into mating engagement with a second threaded head formed at the opposite end of the band. Turning the threaded fastener 52 from a closed position removes it from the opposing end and opens a link gap. The threaded fastener 52 and associated threads on the shank of the connector forms a connection operator which allows manual adjustment of the detachable connector between the closed position wherein the annular link is continuous or closed, and the open position wherein a gap exists in the annular link to allow the connector to be placed about and secured to a connection ring 70 (see FIG. 3).

Detachable connection 60 includes a suitable connection ring, such as the D-shaped ring 70 shown. Ring 70 is preferably made of material the same or similar to the annular connector link 50. Alternative ring or attachment features can also be used to allow connection of annular link 50 or other suitable detachable connectors.

Figure 2:
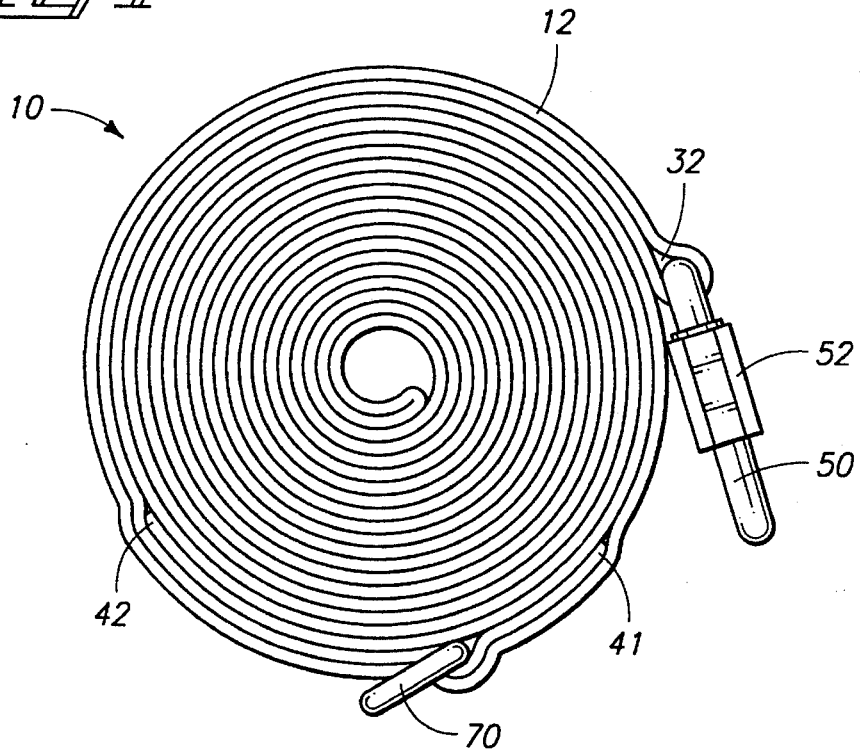
FIG. 2 is a plan view of the restraint article of FIG. 1 shown coiled in a storage condition.

The detachable connection 60 also includes a second end connection section or portion 61 of the tether strap 12 which extends between the second loop 32 and the connection ring 70. This portion is flexed as shown in FIGS. 1 and 2 to form a portion of a detachable connection loop 62. The connection ring 70 and detachable connector 50 form the remaining components which join to provide a closed detachable connection loop 62 as shown in FIG. 3. The connection loop 62 is preferably extended about the connecting chain or other fetter which extends between a pair of handcuffs forming manacles. The restraint 10 is used with the handcuff manacles to provide a particularly effective prisoner restraint system as further described herein. It is thus alternatively appropriate to refer to the detachable connection 60 as a detachable manacle connection.

Figure 4:
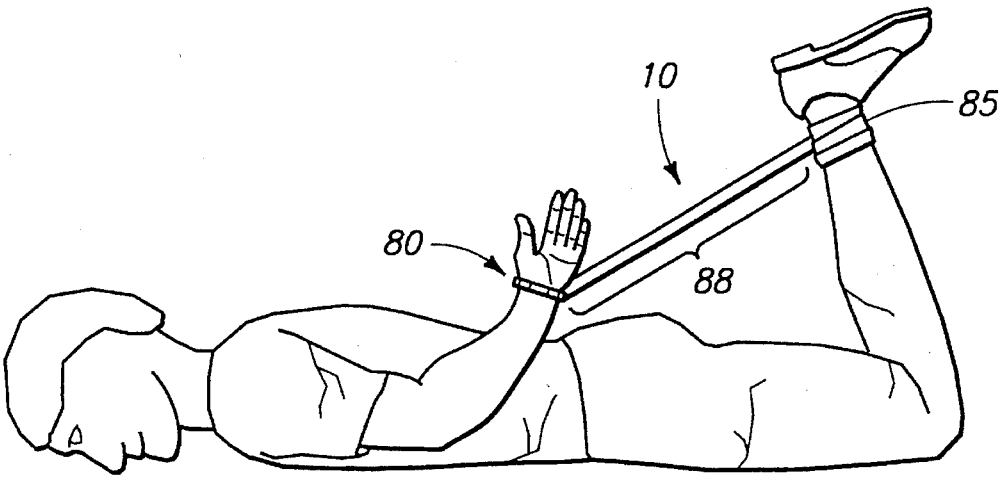
FIG. 4 is a side elevational view showing a prisoner secured using the prisoner restraint of FIG. 1.
Figure 5:
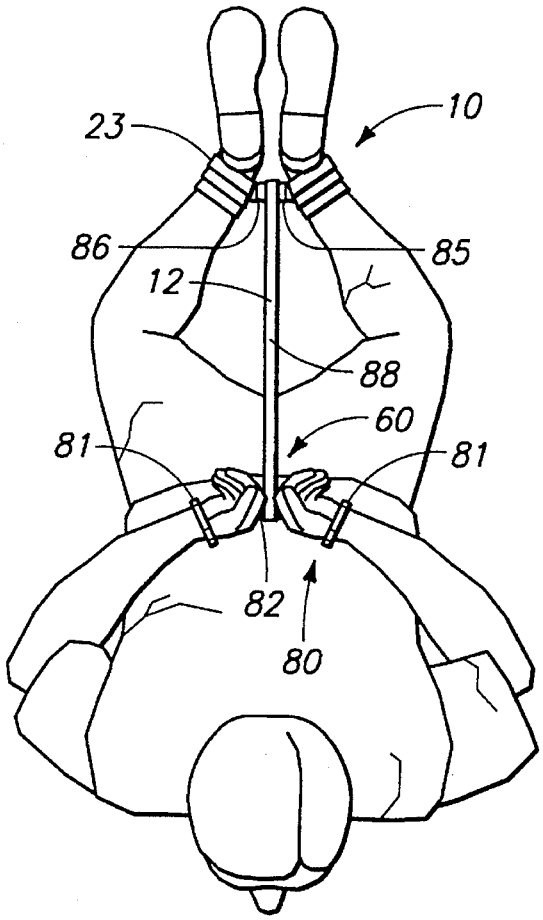
FIG. 5 is a frontal perspective view showing the prisoner of FIG. 4.
Figure 6:
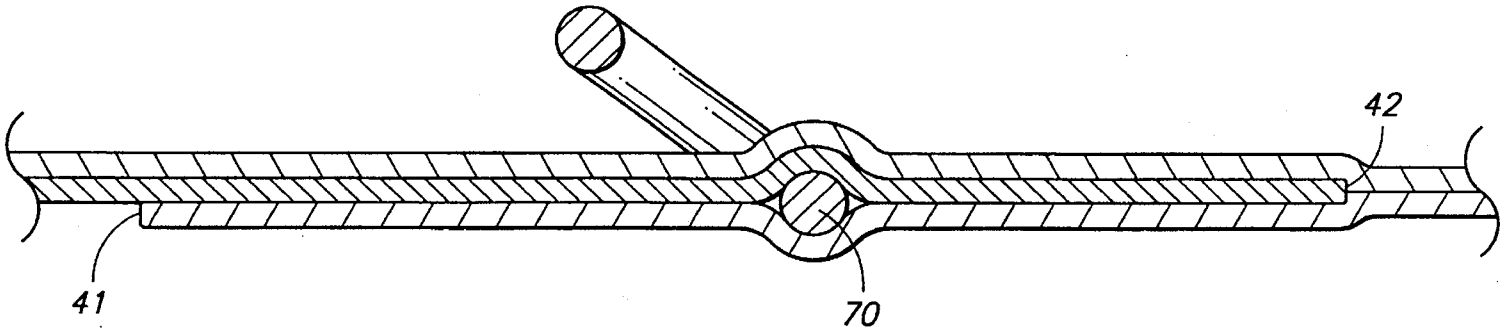
FIG. 6 is a sectional view taken along line 6—6 of FIG. 1.

The manner of using restraint 10 and novel methods for restraining prisoners according to this invention will now be described. FIGS. 4 and 5 illustrate a prisoner bound and restrained using restraint 10 combined with handcuff manacles 80 to provide a novel prisoner restraint system according to this invention. The manacles include two handcuffs and a connecting chain or other fetter 82. The handcuffs are locked about the wrist of the prisoner. Restraint 10 is typically installed after the handcuff manacles have been placed upon the prisoner.

The novel methods include selecting a prisoner restraint having a tether with a first loop formed at a first end and a detachable connection near an opposing second end of the tether, such as the preferred restraint 10 described herein.

Restraint 10 is used and the methods further include forming a noose, such as noose 23. This is done by transforming the first end loop and adjacent tether into noose 23. This transformation is accomplished by turning or doubling back the noose formation section of the tether, adjacent to loop 19 and stitching 20, into the first loop opening. The methods further include installing the noose over the prisoner's leg. This is preferably done by installing the noose over a single leg of the prisoner. The noose is then advantageously tightened upon the leg about the ankle by pulling upon the tether at the second end or at some intermediate position.

The methods further comprise positioning the prisoner's legs in proximity. This can be done by encircling the tether about the legs, such as about the ankles. The resulting turns or circumscriptions provide a laterally restraining action and form a plurality of circumscribing inter-leg chords 85 extending between the prisoner's legs. As shown in FIGS. 4 and 5 the tether has been arranged about the prisoner's ankles to form 2–3 leg constricting circles or circumscriptions having associated chords 85. The tether is preferably encircled about the prisoner's legs in a manner which includes properly wrapping or drawing the tether to a preferred tightness. The tether is wrapped so as to remove excess slack from the circumscribing chords. However, the chords are most preferably not draw so tight that tension is produced in chords 85 at this point of the installation.

The methods further comprise encincturing the tether about the plurality of chords 85. This encincturing is accomplished by passing the tether around the chords 85 in a wrapping action which occurs between the ankles or legs of the prisoner. The resulting wraps form cinctures 86 which constrict upon the plurality of chords 85 to preferably provide a slight degree of tension in the chords. Movement by the prisoner which tugs at the restraint will cause additional tension to be developed thus automatically indicating to the prisoner that further struggle is uncomfortable and undesirable. The tether is encinctured about the chords to preferably form at least one full circle or cincture. More preferably the encincturing includes 1–4 cinctures of the tether about chords 85, even more preferably 2–4 cinctures. The number of cinctures or circles 86 and the number of leg circumscriptions can be varied thus providing the police with an adjustment mechanism to take up more of the length of tether 12. Thus a single restraint 10 can be utilized to handle people of various sizes and proportions.

After the cinctures 86 have been wrapped, the remainder of the tether is extended up the prisoner's torso, preferably along the prisoner's back side as shown in FIGS. 4 and 5. This extending step is typically done after manacles 80 have been installed, if not installed before starting installation of restraint 10. The portion of the tether extending from the cinctures to the second end 16 is herein termed the axial section 88 of the installed restraint. The axial section extends from the cinctures to the manacles 80.

The methods further include securing or connecting the second end of the tether to the manacles locked on the prisoner's arms. This securing is preferably accomplished by running or looping the second end connection section or portion 61 of the tether strap 12 about the chain or other fetter 82 which extends between handcuffs 81. The detachable connection is then secured. As shown, this is accomplished by opening the annular link connector 50 using threaded portion 52 and installing the link upon the connection ring 70 by passing the ring 70 through the gap opened in link connector 50. The connector 50 is then closed by turning the threaded portion 52 to secure the connector and detachable connection loop 62 to the manacles.

Restraint 10 is made by cutting the strip 13 to desired length and then sewing with ring 70 into the configuration shown. Connector 50 is then installed in loop 32 and the restraint is used as described.

In compliance with the statute, the invention has been described in language necessarily limited in its ability to properly convey the conceptual nature of the invention. Because of this inherent limitation of language, it must be understood that the invention is not necessarily limited to the specific features described, since the means herein disclosed comprise merely preferred forms of putting the invention into effect. The invention is, therefore, claimed in any of its forms or modifications within the proper scope of the appended claims appropriately interpreted in accordance with the doctrine of equivalents.

We claim:

1. A method for restraining a prisoner, comprising:

selecting a prisoner restraint having a tether with a first loop formed at a first end and a detachable connection near an opposing second end of the tether;

forming a noose by doubling the tether through the first loop;

installing the noose over the leg of the prisoner;

encircling the tether about the prisoner's legs to provide circumscribing chords which extend laterally between the prisoner's legs to restrain action of the legs;

encincturing the tether about the circumscribing chords between the prisoner's legs to cinch the chords together;

extending the second end of the tether up the prisoner;

securing the second end of the tether to manacles installed on the prisoner's arms.

2. A method according to claim 1 wherein said securing the second end is accomplished by looping a connection segment of the tether about the manacles to form a connection loop and connecting a detachable connector to secure the connection loop.

3. A method according to claim 1 wherein said securing the second end is accomplished by looping a connection segment of the tether about the manacles to form a connection loop and connecting a detachable connector to a ring fixed near the second end of the tether to secure the connection loop.

* * * * *